US006824657B1

(12) United States Patent
Fischer

(10) Patent No.: US 6,824,657 B1
(45) Date of Patent: Nov. 30, 2004

(54) COMPONENT SUPPORT

(75) Inventor: Helmut Fischer, Gechingen (DE)

(73) Assignees: Helmut Fischer GmbH & Co., Sindelfingen (DE); Institut fur Elektronik und Messtechnik

( * ) Notice: Subject to any disclaimer, the term of this patent is extended or adjusted under 35 U.S.C. 154(b) by 0 days.

(21) Appl. No.: 09/889,704

(22) PCT Filed: Jan. 14, 2000

(86) PCT No.: PCT/EP00/00258

§ 371 (c)(1),
(2), (4) Date: Jan. 14, 2002

(87) PCT Pub. No.: WO00/41475

PCT Pub. Date: Jul. 20, 2000

(30) Foreign Application Priority Data

Jan. 18, 1999 (DE) ..... 199 01 624

(51) Int. Cl.[7] ..... C25B 9/00
(52) U.S. Cl. ..... 204/297.02; 335/285; 335/286
(58) Field of Search ..... 204/297.02; 335/285, 335/286

(56) References Cited

U.S. PATENT DOCUMENTS 4,575,702 A * 3/1986 Nitta et al. ..... 335/286
4,616,796 A * 10/1986 Inoue ..... 248/206.5
5,428,331 A * 6/1995 Graner et al. ..... 335/285
5,618,396 A * 4/1997 Hiermaier et al. ..... 204/297.02
6,545,579 B1 * 4/2003 Dimke et al. ..... 335/285

* cited by examiner

*Primary Examiner*—Bruce F. Bell

(57) ABSTRACT

A component carrier for holding at least one component (12), in particular for surface coating by electrodeposition, having at least one holding magnet (31), the magnetic field lines of which run through the component (12) in a region close to a contact surface (36), having a diaphragm (16), which accommodates the at least one component (12) in a holding position (38) with respect to the at least one holding magnet (31) on at least one contact surface (36) of an electrically conductive housing (14), the pole axis of the at least one holding magnet (31) being positioned transversely with respect to the contact surface (36), in which component carrier a resulting magnetic holding force which acts on the at least one component (12) in the holding position (38) can be reduced by displacement of the at least one holding magnet (36) out of the holding position (38) or by displacement of the at least one component (12) out of the holding position (38) or by a relative movement of the at least one component (12) and the at least one holding magnet (31) with respect to the holding position (38).

42 Claims, 7 Drawing Sheets

COMPONENT SUPPORT

The invention relates to a component carrier for holding at least one component, in particular for surface coating by electrodeposition.

BACKGROUND OF THE INVENTION

DE 44 9 982 C1 has disclosed a holding device for coating components by electrodeposition. This device has a component carrier, which in its cavity along a contact surface has two extending magnets, the pole axis of which is oriented transversely with respect to the contact surface. The components are held on a contact surface of an electrically conductive component carrier by means of the magnet strips extending along the device, the electrically conductive contact surface extending on an outer side of the component carrier, which is of hollow design. The component carrier is designed as an elongate electrode for the surface coating of the components by electrodeposition. The components are arranged one behind the other in a row on a contact surface, a diaphragm which accommodates the components and positions then with respect to the contact surface being provided.

For surface coating by electrodeposition of the components accommodated by this holding device, the individual holding devices are arranged on, for example, a circular frame, in order to be immersed in the baths for coating.

Holding devices of this type have the drawback that only a small number of components can be accommodated for surface coating. The device, which is, for example, 1.20 m long, is very heavy and difficult to handle, requiring complex equipment with an extremely low capacity in order to carry out the coating, which requires a plurality of successive process steps.

Furthermore, this holding device has the drawback that, following the surface coating of armatures for injection nozzles, high-precision and high-sensitivity components of very low weight have to be removed from the holding device, while a considerable force is required for this purpose in order to overcome the magnetic holding force acting on the component in question. Consequently, the surface or coating of the components may be damaged as a result of the high levels of mechanical action required in order to overcome the magnetic holding force, with the result that this part has to be removed from production as scrap. Furthermore, the holding devices, which are of disproportionate size compared to the component size and are very heavy, have the drawback that, on account of bath liquids being entrained while the process steps for electrodeposition are being carried out, environmental problems may arise and, furthermore, a high consumption of bath liquid is required.

SUMMARY OF THE INVENTION

Therefore, the invention is based on the object of providing a component carrier in which, in order to improve the automation of the mounting and removal operation, the components can easily be mounted on and removed from the component carrier, while the entrainment of the bath liquid during the coating process is to be reduced. Furthermore, the risk of mechanical damage to the components during the mounting and removal is to be reduced, and during the coating process the required holding force for securely arranging the components with respect to the contact surface of the component carrier must be present.

The inventive design of the component carrier has the advantage that, at least during the removal operation, the adhesive force or holding force of the magnet acting on the component in question can be reduced. This makes it easy to lift the component off a contact surface without the risk of mechanical damage to the highly sensitive components, since extremely minor engagement or holding forces are required at least for removal of the component. The at least slight displacement of the component, of the holding magnet or a relative movement between the component and the holding magnet with respect to a holding position leads to a reduction in the resulting magnetic holding force with respect to the component, so that a lower force is required to lift off the component at least for removal. This effect is based on the fact that the further the component is positioned outside a resultant of the forces of the holding magnet, the greater the decrease in the field strength of the magnet and therefore also in the adhesive force. The components are advantageously formed from ferromagnetic material. The device according to the invention may advantageously be used for surface coating of the components by electrodeposition.

An alternative design of the component carrier according to the invention has the advantage that, on account of at least one magnetic interlayer which can be arranged between component and holding magnet, small masses are moved, a towing the resulting holding force of the magnet on the component to be reduced. Providing the magnetic interlayer makes it possible to achieve a shielding effect on the holding magnets with respect to the component, with the result that the adhesive force of the component with respect to the contact surface can be reduced at least for removal, thus ensuring that the component is easy to lift off. The shielding may also be advantageous for the mounting operation, so that the components can be placed gently on the contact surface. This also applies to the inventive design of the component carrier which will be described further in the specification along with other advantages of the invention.

Further advantageous embodiments of the invention will emerge from patent claims 2 to 42.

According to an advantageous configuration of the invention, the component carrier has a plurality of holding positions which are provided in an arrangement in the form of lines and columns with respect to a contact surface of the housing. Consequently, a large number of components, in particular in the case of small or extremely small components, can be accommodated within a confined space of a component carrier, with the result that the overall volume of the component carrier and the weight can be reduced by a considerable extent, thus simplifying and facilitating handling.

According to a further advantageous configuration of the invention, a holding magnet, which preferably comprises at least two magnet poles of opposite polarity facing the component, is provided for each holding position. This enables each component, in the holding position, to be assigned an individual holding magnet. This configuration has the advantage, in particular, that no magnetic material is present in the spaces between the individual components along a row of components, as is known, for example, from the holding device according to the prior art. Consequently, neutral zones which exert an extremely low holding action on the component through the resultant of the magnetic field lines can be formed between the individual holding magnets. Consequently, the maximum magnetic holding force can be reduced to a minimum or to zero. The resulting adhesive force of the individual holding magnet preferably lies in a holding position.

According to a further advantageous configuration of the invention, the individual holding magnets, which comprise at least two magnetic poles and have at least two magnetic poles of opposite polarity facing the component, are arranged in a row with one another, so that the polarities are identical along a row. As a result, it is possible, for example, to create a neutral zone, in which both one individual magnet and the other individual magnet exert a scarcely perceptible holding force on the component, can be created, for example, between these two individual magnets. A slight displacement of the component out of the neutral zone, which advantageously lies in the center of the two adjacent individual holding magnets, can lead to immediate orientation of the individual holding magnets with respect to the holding position, so that the resultant of the forces of the individual holding magnets lies in the holding position.

As an alternative to the embodiment described above, it is possible for the polarities of the individual holding magnets to be arranged alternately with respect to the contact surface.

According to a further advantageous configuration of the invention, the component carrier has an electrically conductive housing in which there is a carriage which accommodates the holding magnets and is arranged displaceably with respect to the holding position of the components. This can make it possible for the holding force acting on the components to be reduced and, if appropriate, cancelled out at the same time and to the same extent for all components as a result of the movement of the carriage. For specific applications, it is also possible, if necessary, for one or more holding magnets to be displaced in rows or columns with respect to the holding positions.

It is advantageous for a plurality of strips arranged parallel and next to one another to be provided on the carriage, which strips accommodate at least two magnetic poles to the left and right of the strip and at a distance from one another along the strip. This makes it possible to achieve a high density of the holding positions on a small contact surface of the component carrier, the distance between the individual magnets being in relation to the component size. It as advantageously provided for a gauge distance, i.e. the distance between the center axes of two components, to be at least 1.5 times the component diameter. This distance is advantageously twice the component diameter, in which case the displacement amounts to half the gauge distance.

According to a further advantageous configuration of the invention, the strips for accommodating the individual magnets are provided in recesses in a support frame of the housing, which accommodates the contact surface on its opposite surface. Consequently, the contact surface can be supported to a sufficient degree, since the holding position of the components lies in the recesses or between the webs of the support plate. The holding magnets are advantageously provided with a small air gap beneath the contact surface, so that it is possible to provide a contact-free and therefore low-friction arrangement of the carriage with respect to the contact surface. On account of the magnetic force which is active, it is possible, by means of the design of the support surface, to allow the contact surface to be arranged and held flat against the component carrier.

For mounting and removal on the component carrier, it is advantageous for the component carrier to be arranged on a bracket which on two opposite end faces has magnet elements which each have an opposite polarity in the direction of the component carrier. The carriage which is displaceable in the component carrier has, corresponding to the magnet elements of the bracket, on its end edges, magnet elements which are equipped with the same polarity and face toward the magnets of the bracket. Immediately after insertion, a repelling action can be achieved on one end side as a result of the identical polarity and an attracting action can be achieved on the opposite side, with the result that the carriage together with the individual holding magnets is guided out of a holding position. The amount of displacement can advantageously be determined by means of an adjustable stop, so that the holding magnets are arranged in an neutral zone for the purpose of mounting and removal of the components. It is advantageous for it to be possible for the carriage to move in both directions irrespective of the orientation in which it is inserted in the bracket. Alternatively, it is possible for the component carrier to be oriented with respect to the bracket. This could be the case, for example, if a slight attraction force is desired for the mounting operation, so that the components are positioned flat and in full contact with the contact surface and are to be attracted slightly during the positioning operation. In an application of this type, the amount of displacement in one direction is smaller than the amount provided for the removal operation.

BRIEF DESCRIPTION OF THE DRAWINGS

Preferred exemplary embodiments of the invention are described in more detail below in the description and the patent claims. In the drawing:

DETAILED DESCRIPTION OF THE INVENTION

Figure 1:
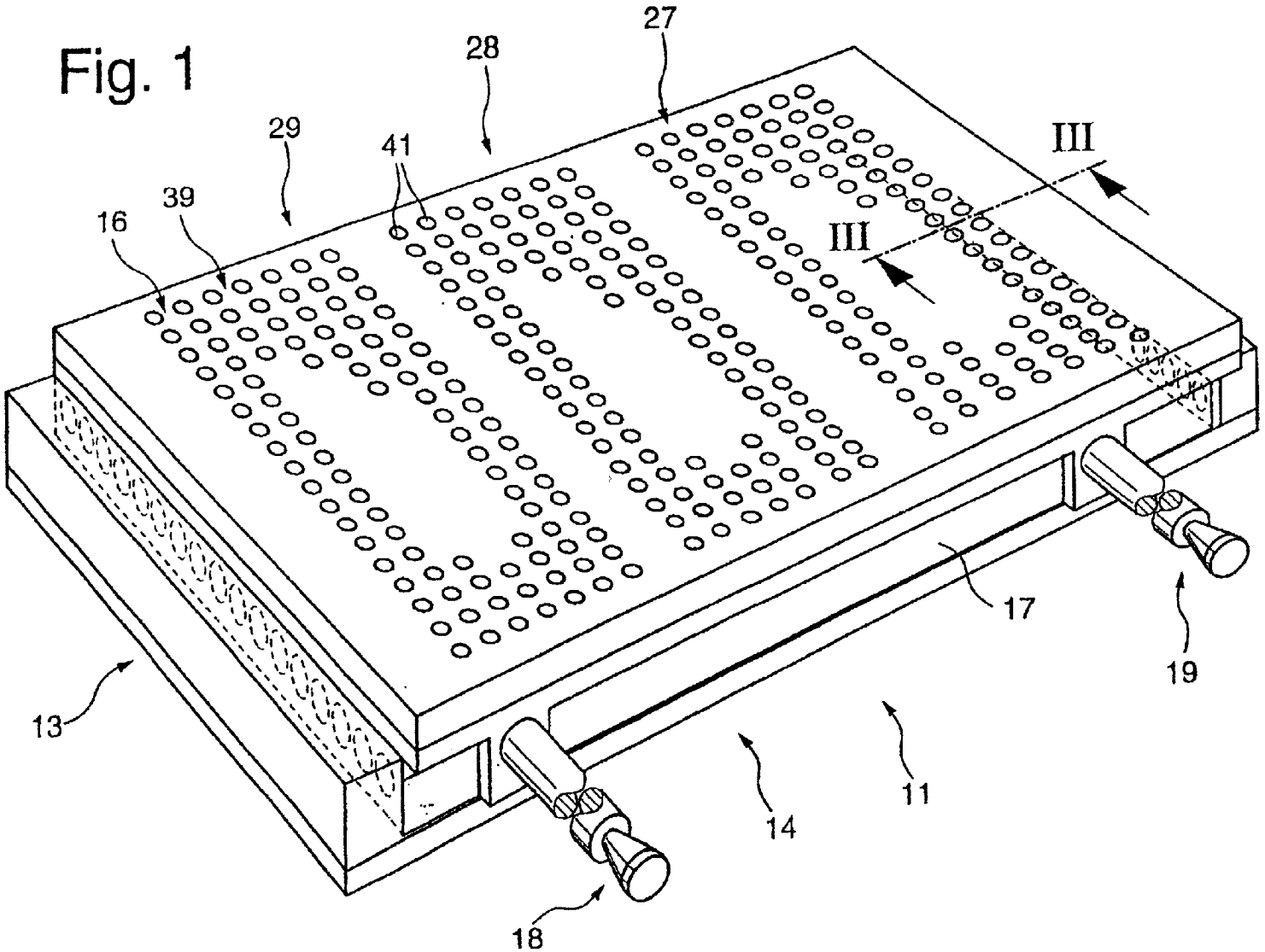
FIG. 1 shows a perspective view of the component carrier according to the invention.
Figure 3:
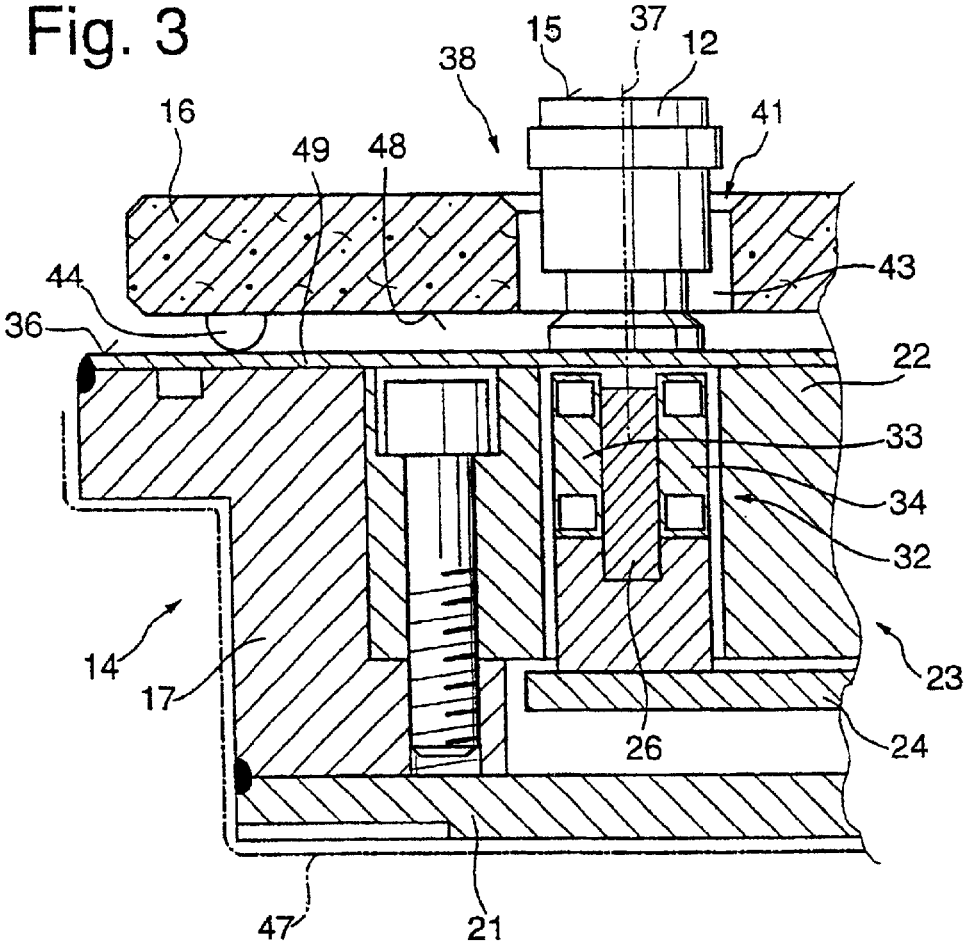
FIG. 3 shows a diagrammatic, partially sectional illustration on line III-III in FIG. 1.

FIG. 1 shows a perspective illustration of a component carrier 11 according to the invention, which can be arranged as required on a bracket 13 for the mounting and removal of components 12 (FIG. 3). The component carrier 11 serves to accommodate a multiplicity of components 12, the surface of which is at least partially surface-treated or coated. In this application example, the components 12 are armatures for injection nozzles in internal combustion engines, which are produced with a high level of accuracy and the surface of which is extremely sensitive. These components 12 are very lightweight and weigh, for example, 1 g. At least one end side 15 of the components 12 is to be coated by electrodeposition, preferably with a chromium layer or a layer of a chromium alloy. For these components 12, it is essential that mechanical or other damage to the component surface and its coating be avoided during the handling before and after coating, since this would cause production to be scrapped. Naturally, the component carrier described below can also be used and adapted for further applications and other component sizes and weights.

The component carrier 11 has a housing 14, to which a diaphragm 16 is exchangeably attached. At least one clamping pin 18 and a contact bolt 19 are provided on a frame 17 of the housing 14, so that the component carrier 11 can be attached to a device in order to pass through the individual process steps involved in the coating of the surface, such as for example for hard chromium plating in an electrodeposition bath. The successive process steps comprise, for example, rinsing, roughening, coating and drying of the components. The contact bolt 19 is used to apply a cathode voltage to the holder, so that the chromium ions, for example, can precipitate on the component 12.

Figure 2:
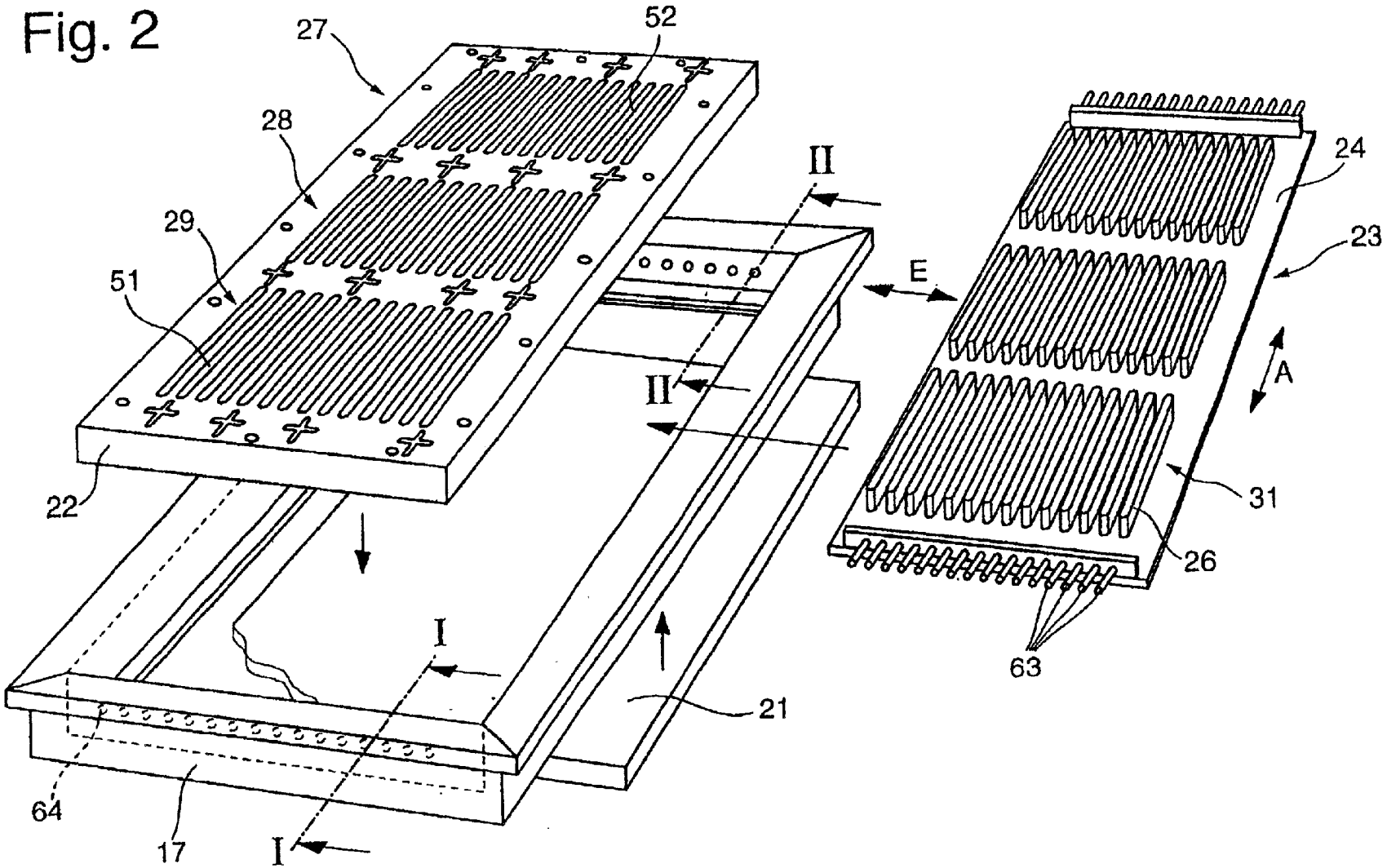
FIG. 2 shows a diagrammatic illustration of individual parts of a housing of the component carrier according to the invention.
Figure 4A:
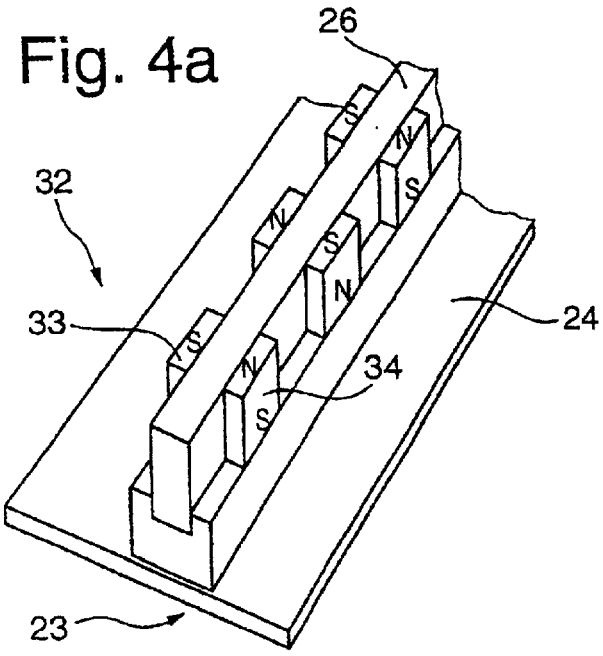
FIG. 4*a* shows a diagrammatic detailed illustration of a plurality of individual holding magnets.
Figure 4B:
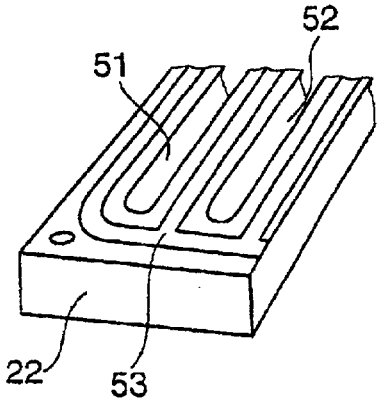
FIG. 4*b* shows a diagrammatic detailed illustration of a support frame of the housing.

FIG. 2 shows an exploded view of the housing 14. A base plate 21, which closes off the housing 14 at the bottom, is provided on the underside of the frame 17. A support frame 22, which is shown in more detail in FIG. 3 and is releasably attached to the frame 17 by a screw connection, is inserted into the frame 17. A carriage 23, which can be moved to and fro in the frame 17 in the direction indicated by arrow A, is provided between the base plate 21 and the support frame 22. Strips 26 which are arranged parallel to one another are provided on the carriage 23, so that an arrangement of, for example, three areas 27, 28 and 29 results. These strips 26 accommodate holding magnets 31 which, in the exemplary embodiment shown in FIG. 4*a*, are designed as individual holding magnets 32. The individual holding magnets 32 have a left magnet 33 and a right magnet 34, which are spaced apart from one another by the strip 26 as a nonmagnetic interlayer, so that a neutral zone is provided between the magnets 33, 34. The magnetic poles of the magnets which is arranged on the support frame 22 and the frame 17. The pole axis 35 of the individual magnet 32 is advantageously congruent with a center axis 37 of the component 12. The arrangement of the left and right magnets 33, 34 to form an individual magnet 32 has the further consequence that a resulting magnetic holding force is provided which, when a component 12 is arranged in a holding position 38, as illustrated in FIG. 3, is congruent with the center axis 37 of the component 12. It is therefore possible for a maximum magnetic holding force to act on the component 12, which is produced from a ferromagnetic material.

The holding position 38 for a component 12 is determined on the one hand by an array of holes 39 in areas 27, 28 and 29 and also, correspondingly, by the individual holding magnets 32. In this case, it is provided that the resulting magnetic holding force of the individual holding magnets 32 lies in the center axis 37 of the component 12, with the result that the holding position 38 is determined. The component 12 is held with respect to the holding position 38 by a bore 41 of the array of holes 39, which is provided in a diaphragm 16.

Figure 4D:
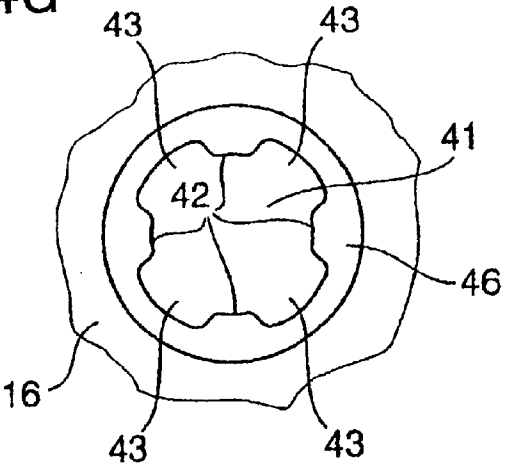
FIG. 4*d* shows a diagrammatic detailed illustration of a bore in a diaphragm for accommodating a component.

As shown in FIG. 4*d*, the bore 41 advantageously has guide segments 42 which lie on a diameter which is only slightly greater than the diameter of the component 12. In the present application, a cylindrical component 12 is provided, in which case the diameter on which the guide segments 42 lie may be designed to be in the range between 1/10 and 1/100 mm larger. In addition to the guide segments 42, the bore 41 has flushing channels 43, which allow the liquids used during the individual process steps for coating of the surface of the component 12 to flow away rapidly. For this purpose, it is advantageous for the diaphragm 16 to be spaced apart from the contact surface 36 by spacers 44.

It is also possible for flushing channels to be provided on an underside 48, which faces toward the contact surface 36, of the diaphragm 16, in order to promote the outgoing flow of the liquids. The diaphragm 16 is advantageously formed from nonconductive acid-resistant material. By way of example, a diaphragm 16 made from ceramic which has a plastic coating is provided. Alternatively, it is also possible to provide a Halar-coated metal. For better insertion of the components 12, the bore 41 has inclined insertion surfaces 46.

The support plate 22 has slot-like recesses 51, in which the strips 26 with the individual magnets 32 are positioned, in an arrangement which corresponds to that of the strips 26 on the carriage 23. Support webs 52, against which the contact surface 36 bears, are provided between the recesses 51. This enables a sufficiently large rest or support surface to be created for the contact surface 36, which makes it possible to ensure that the contact surface 36, despite the resulting magnetic adhesion force of the individual holding magnets 32 on the component 12, does not undergo any deformation. Small indentations 53 for accommodating an adhesive on the contact surface 36 are advantageously machined into the support webs 52. The contact surface 36 comprises a film or foil 49, preferably a nickel/iron foil which preferentially has a rhodium-plated surface. This enables the conductivity to be increased considerably, with the result that the deposition of the coating on the free section of the component 12 projecting out of the diaphragm 16 can be increased.

The strips 26 with the individual holding magnets 32 are provided without contact in the recesses 51 of the support frame 22 and with respect to the contact surface 36. A small air gap is provided between the individual holding magnets 32 and the contact surface 36. The closer the individual holding magnet 32 is arranged to the component 12, the greater the resulting adhesive force which acts on the component. The plate 24 is at a distance from the support frame 22, a rolling bearing arrangement 54, preferably a ball bearing, being provided between support frame and plate 24, in order to keep the friction work required for movement of the carriage 23 low. Alternatively, it is also possible to provide a slide coating or the like on the plate 24 and that surface of the support frame 22 which bears against it.

Figure 4C:
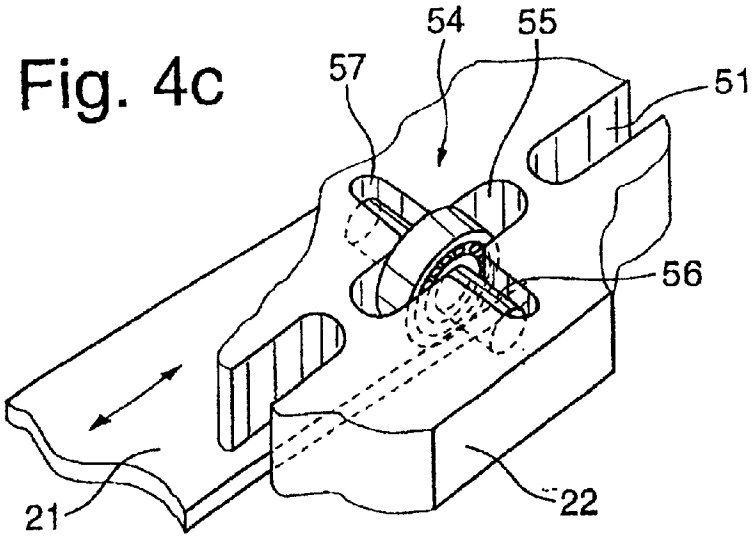
FIG. 4*c* shows a diagrammatic detailed view, from below, of the support frame.

FIG. 4*c* shows a view of the support frame 22 from below. A ball bearing which rotates about a rotation pin 56 arranged in a groove 57 is positioned in an elongate bore 55. The rotation pin 56 may advantageously simply be laid in the groove 57, since the carriage 23 is pressed against the rolling bearing 54 on account of the magnetic force of the individual holding magnets 32 which acts on the contact surface 36. Furthermore, rolling bearings which engage in recesses in the plate 24 are provided on the underside of the support frame 22, in order to allow a controlled longitudinal movement of the carriage 23 in the direction of arrow A.

The housing 14 is completely closed. An inert atmosphere can be created in the interior of the housing 14 by means of a valve, so that the components located in the interior of the component 12 can remain free of corrosion. The atmosphere may be created by sulfur hexafluoride or argon.

Furthermore, apart from the contact surface 36 and the contact bolt 19 as well as a contact path between the contact bolt 19 and the contact surface 36, the housing 14 is surrounded by an acid-resistant coating 47. It is possible for this coating to be a plastic coating known as ECTFE. This plastic is sealed and consolidated so that it is free of pores and protects against aggressive acid.

The division of the bores 41 in the diaphragm 16 for forming the holding position 38 in the areas 27, 28 and 29 is dependent on the size of the component 12 and the type and configuration of the holding magnets 31. The components in this example are very small and sensitive components which weigh only a very few grams. Therefore, an arrangement in lines and columns was selected for an array of holes to form an area 27, 28, 29, the number of lines and columns being selected taking account of a binary code. In this way, it is possible to facilitate mounting and removal and the testing of the occupied holding positions by computer programs. The number of areas 27, 28, 29, on the one hand, and the lines and columns, on the other hand, can be selected according to the particular application.

Figure 5:
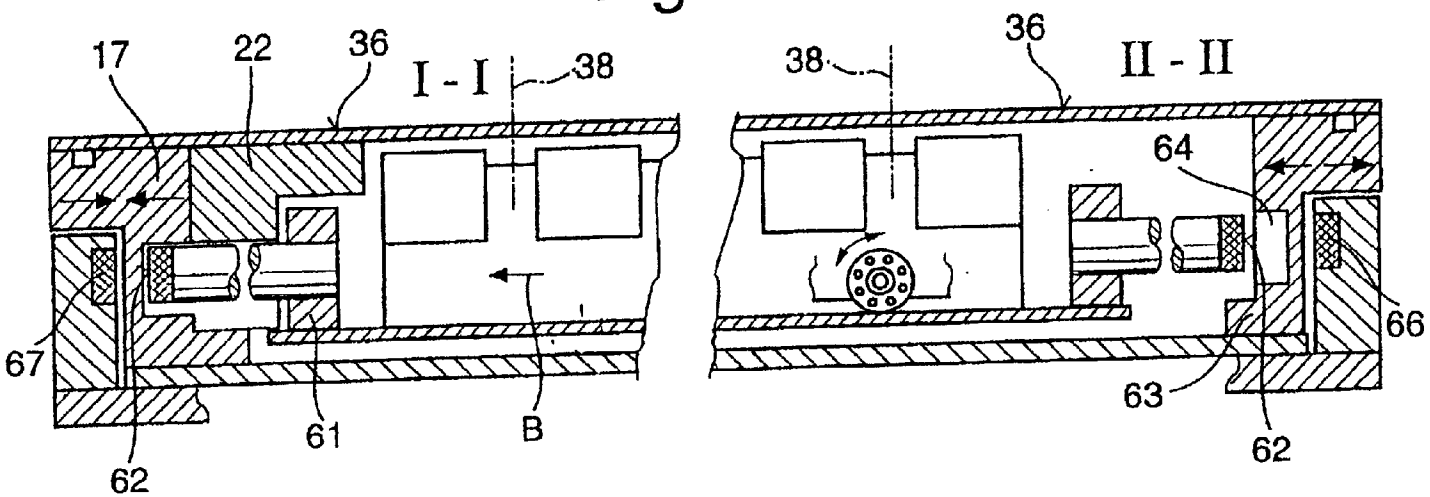
FIG. 5 shows a diagrammatic side view on section line I-I and II-II from FIG. 2, FIGS. 6*a* to 6*c* diagrammatically illustrate the principle of action with the individual holding magnets oriented in the same direction, FIGS. 7*a* to 7*c* diagrammatically illustrate the principle of action with the individual holding magnets oriented in an alternative way to that shown in FIGS. 6*a* and 6*b*.

FIG. 5 shows a diagrammatic sectional illustration on lines I-I and II-II in FIG. 2. The carriage 23 has been transferred out of a holding position 38 for the components 12 into a mounting or removal position in the direction of arrow B. For this purpose, on two opposite end sides the carriage 23 has a section 61 for accommodating magnet elements 62. These magnet elements 62 are oriented in such a manner that in each case the same polarity faces toward the opposite side of the frame 17. The frame 17 has indentations 64 on the corresponding end side 63, with the result that the residual wall thickness of the frame 17 is reduced. In this way, it is possible to increase the active magnetic force which acts on the carriage 23 of the component carrier 11 as a result of magnets 66, 67 in the bracket 13. In this case, it is provided that, by way of example on the left-hand side, the magnet 67 facing toward the frame 17 has an opposite polarity to the magnet element 62 of the carriage 23, while the magnet element 66 of the bracket 13 has the same polarity as the magnet element 62 of the carriage 23. This results in a repelling effect on the right-hand side and an attracting effect on the left-hand side, with the result that the carriage 23 is transferred out of a holding position 38, in the direction indicated by arrow 3, into a mounting or removal position. It is advantageously possible for the component carrier 11 to have markings, so that it can be inserted into the bracket 13 in a defined way. This can likewise be achieved by means of a tongue-and-groove system or the like.

The displacement of the carriage 23 together with the individual holding magnets 32 out of a holding position 38 into a mounting or removal position has the advantage that the resulting magnetic holding force is reduced. This is to be explained in more detail, by way of example, with reference to FIGS. 6*a* to 6*c*.

Figure 6A:
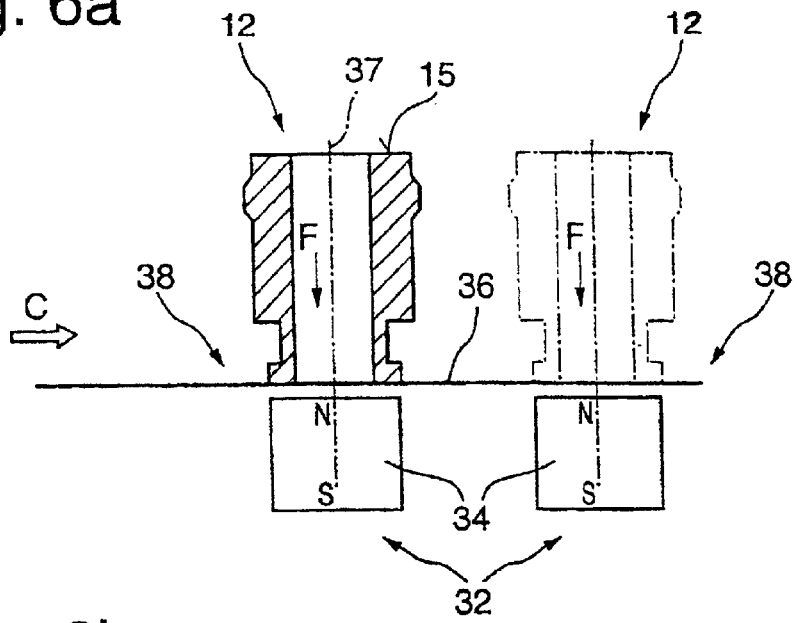
Figure 6B:
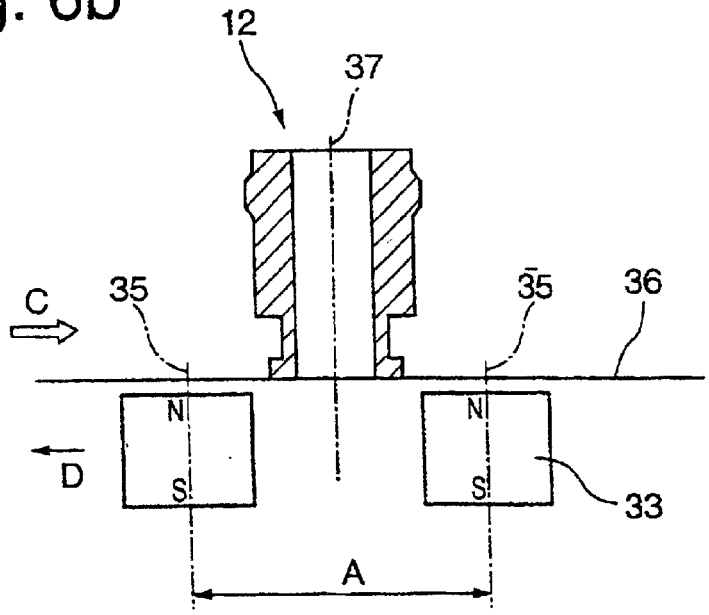
Figure 6C:
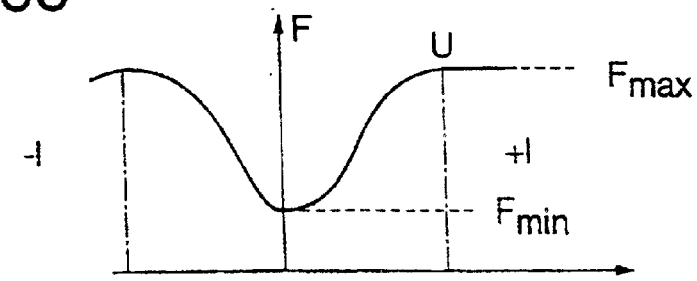
Figure 7A:
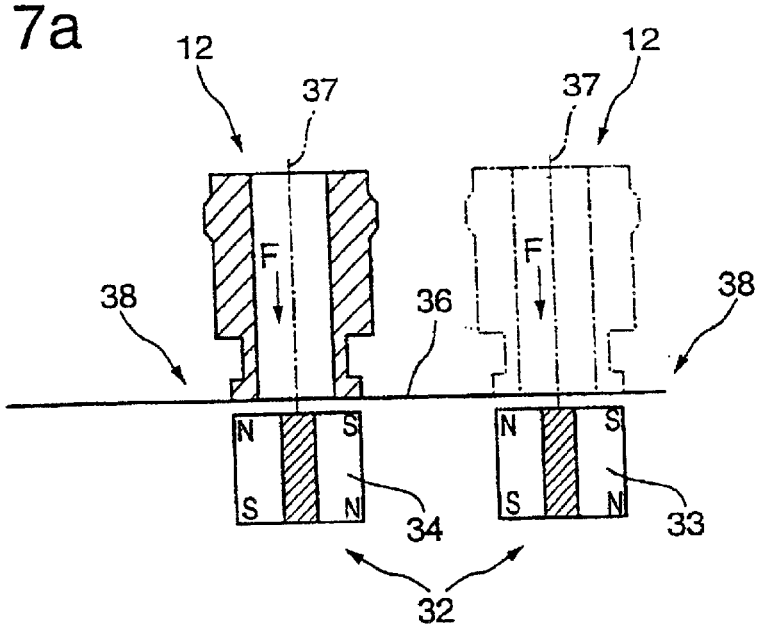
Figure 7B:
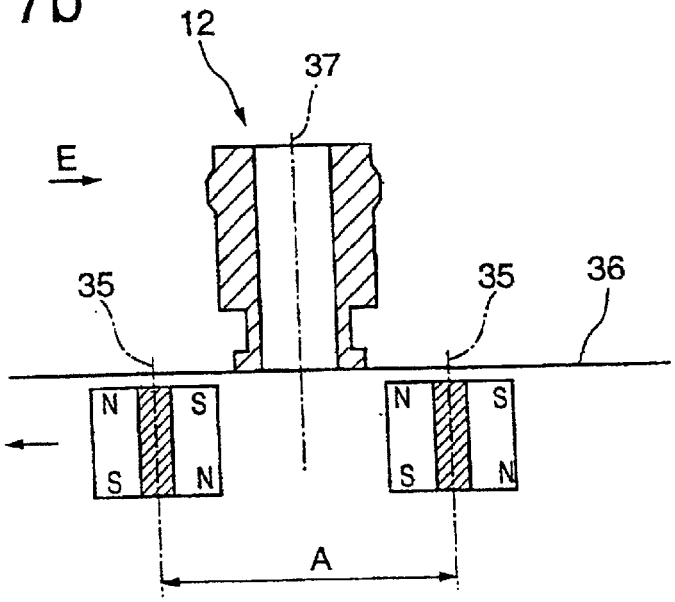
Figure 7C:
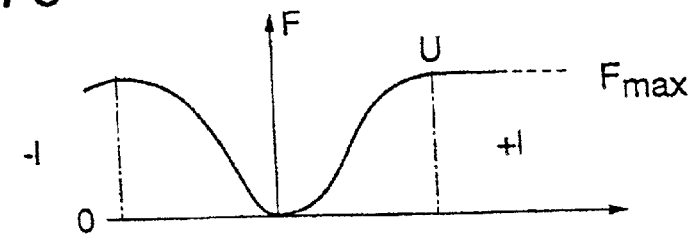

As illustrated in FIGS. 6*a* and 6*b*, the adjacent individual magnets 32 shown in FIG. 3 have the same polarity facing the components 12. When the individual holding magnets 32 are displaced in the direction of arrow D or when the components 12 are displaced in the direction of arrow C, or when the components 12 are moved in the direction of arrow C and the holding magnets 32 are moved in the direction of arrow D, into the position illustrated in FIG. 6*b*, it is possible for the resulting magnetic adhesion force to be reduced as shown in the diagram illustrated in FIG. 6*c*. A neutral zone can be formed between the individual holding magnets 32, which zone is considerably weaker, in terms of the forces which are active, than in the holding position 38. As soon as the carriage 23 is positioned at least slightly to the left or to the right in the direction of arrow D or arrow C, it is moved in such a manner, on account of the action of magnetic forces, that the pole axis 35 is positioned congruently with respect to the center axis 37 of the component 12. As an alternative to FIGS. 6*a* and 6*b*, it is possible to allow a displacement in the direction of arrow E of the individual holding magnets 32, as shown in FIG. 7*b*. This direction of displacement takes place at right angles to the direction of displacement shown in FIG. 6*b*. On account of the polarity of the left and right magnets 33, 34 of the individual magnets 32, the force lines in a region between the two individual magnets virtually cancel one another out, resulting in the profile of the magnetic adhesion force between two holding positions 38 which is shown in the diagram in FIG. 7*c*. With a number of n components 12 in a row, at least a number n+1 of individual holding magnets 32 are provided along a strip 26, so that it is ensured, in the event of a displacement of the components 12 and/or of the individual magnets 32, that the components 12 are positioned in a neutral zone, as illustrated in FIG. 6*b* and 7*b*.

Advantageously, in each case one additional individual holding magnet 32 is provided at the end of each strip 26, so that the direction of displacement can take place on both sides.

Alternatively, it is also possible for the holding magnets 31 to be displaced downward out of the holding position 38 along the pole axis 35, which would require a relatively great displacement in order to reduce the adhesion force.

This reduction in the magnetic force resulting on the component can also be achieved if, as an alternative to the arrangement of the individual holding magnets 32 shown in FIGS. 6*a* and 6*b*, an arrangement shown in FIG. 4*a* is selected. The arrangement of the poles of the magnets 33 and 34 alternates with respect to the component 12, so that in the event of a displacement of the component 12 or of the individual holding magnets 32 in the direction of arrow D the same effect can occur.

An alternative configuration of the invention can be provided if, instead of the magnet 33 and 34 to form an individual holding magnet 32, magnetic strips are provided, the length of which in sections or completely corresponds to the areas 27, 28 and 29. With this configuration, it would be necessary for the direction of displacement to the holding positions 38 to be in the direction of arrow E. The direction of displacement of the carriage 23 indicated by arrow A can be maintained if the strips 26 within the areas 26, 27 and 28 are rotated through 90°. Furthermore, it is possible to use further alternative arrangements, such as for example a cylindrical magnet, a cube, an annular magnet or a plurality of magnet elements which are associated with one another as a holding magnet, to be used instead of the individual holding magnets 32 which are formed from the magnet 33 and 34.

It is advantageous for the gauge distance A, that is to say the distance between the center axes 37 of two spaced-apart components 12, to be twice the component diameter. The displacement corresponds to the component diameter. In this way, it is possible to achieve a high packing density. It is advantageous if the size of the holding magnets 31, in particular in terms of the end face which faces toward the component 12, is smaller than or equal to the circumferential area of the component 12 or the surface by means of which the component 12 bears against the contact surface 36. The high packing density allows the cycle time for the components to be reduced considerably.

The design of the magnets 66, 67 for the displacement work of the carriage 23 for mounting and removal of the components 12 is dependent on the number of components 12 and on the size of the individual holding magnets 32 which hold the respective component 12 with respect to the contact surface 36. By way of example, a component carrier 11 with 16×24 rows and columns accommodates 384 components 12. For an adhesion force of approximately 200 g/magnet, which corresponds to approximately 200 times the weight of the component 12 itself, the magnetic force which is active is a total of 76 kg. This force also acts on the support frame 22 between the carriage 23. A resulting frictional force needs to be overcome for displacement of the carriage 23, in order for the carriage 23 to be transferred out of a holding position into a mounting and removal position.

Figure 8:
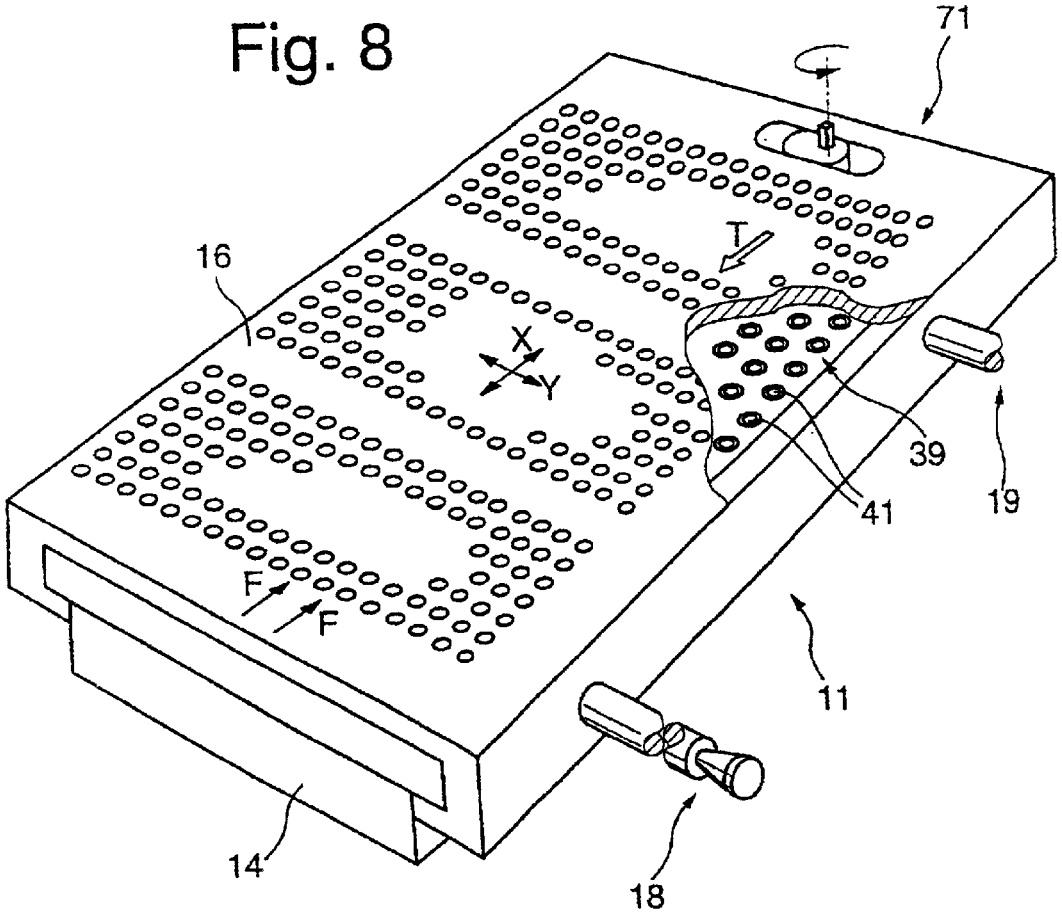
FIG. 8 shows a perspective view of an alternative embodiment to that shown in FIG. 1, and FIGS. 9*a* and 9*b*: diagrammatically depict the principle of action of the alternative embodiment shown FIG. 8.
Figure 9A:
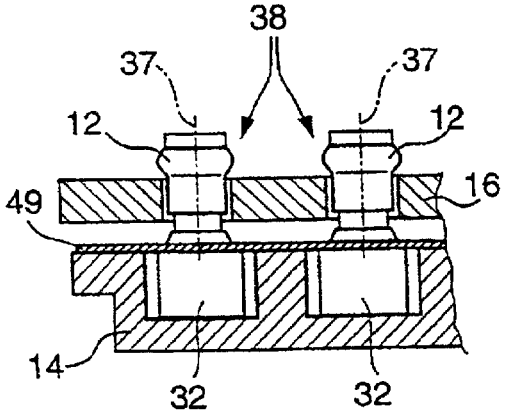
Figure 9B:
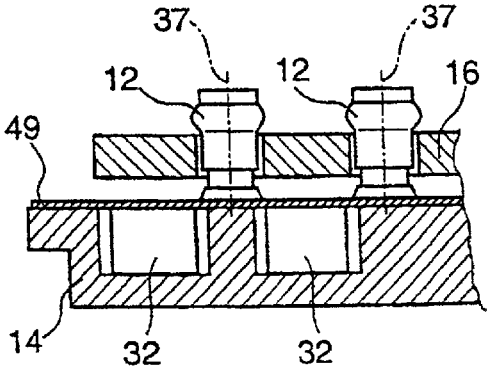

FIG. 8 shows an alternative embodiment of a component carrier 11 to that shown in FIG. 1, the principle of action of which is diagrammatically illustrated in FIGS. 9*a* and 9*b*. Compared to the embodiment shown in FIG. 1, the moving parts have been switched. In this embodiment, the components 12 are moved out of the holding position 38 with respect to the individual magnets 32, with the result that the active principles described in FIGS. 6 and 7 can likewise apply, The displacement of the diaphragm 16 may be effected by an eccentric mechanism 71 or the like. The diaphragm 16 advantageously has a C-shaped profiling which at least partially engages around the contact surface 36 and is simultaneously guided thereon. The housing 14 may be of simplified configuration to the extent that the support frame 22 simply has receptacles for positioning of the holding magnets 31.

It will be understood that it is likewise possible to provide a combination of the embodiment shown in FIGS. 1 and 8 or any embodiments which are based on or differ from the latter, so that it is possible to reduce or lower the magnetic holding force by displacement of the components 12 or holding magnets 31 with respect to the holding position 38 or by means of a relative movement between the components 12 and the holding magnets 31.

The component carrier 11 according to the invention is advantageously used in the following way in a coating process: the components 12 which are to be coated are discharged from an annealing station via a plate conveyor and are fed to a mounting station. In this mounting station, the component carrier 11 is placed onto the bracket 13. On account of the orientation of the magnets 66 and 67 and the fact that the component carrier 11 is arranged in the correct position, it is possible for the carriage 23 to be transferred into a mounting position. This mounting position of the carriage 23 may be such that the individual holding magnets 32 are not transferred completely into the neutral zone, but rather are only partially removed from the holding position 38. This allows a slight magnetic force to act on the components 12, with the result that they bear flat against the contact surface 36 during the mounting operation. After the mounting operation has been completed, the component carrier 11 is removed from the bracket 13, with the result that the carriage 23 is automatically transferred into a holding position 38 on account of the action of the magnetic force of the holding magnets 31. The maximum resulting magnetic adhesion force lies in the center axis 37 of the component 12. The component carrier 11 is attached to a frame at the clamping bolt 18 and the contact belt 19 and is fed for electrodeposition. After the process steps for the surface coating have been passed through, the component carrier 11 is positioned back on a bracket 13. This position may, for example, be rotated through 180° with respect to the mounting position, so that the carriage 23 is positioned in an opposite direction, in order for the holding magnets 31 or components 12 to be arranged in the neutral zone with respect to the holding magnets 31. This allows simple removal of the components 12 without any force or with only a slight force being required to pull them off, so that it is possible to eliminate the risk of mechanical damage. After all the components 12 have been completely removed, the component carrier 11 is returned again and made available for the next mounting operation.

An alternative configuration of a component carrier provides for an interlayer to be arranged displaceably between the contact surface 36 and the holding magnet 31. This magnetic interlayer, which has a high permeability, has areas and free spaces arranged in rows and columns, with the result that the interlayer, depending on its positioning between the component 12 and the individual holding magnet 32, can serve as a shield. For the mounting and removal operation, it is provided for the interlayer to be displaced in plane-parallel fashion with respect to the contact surface 36, in such a manner that the areas which are at least highly permeable cover that end side of the individual holding magnet which faces toward the component, so that the adhesive force resulting on the component can be reduced. This facilitates mounting and removal. During the treating or coating process of the components, the interlayer is transferred into a position in which the free spaces provided between the areas are positioned between the individual holding magnet and the component. As a result, the resulting adhesive force of the individual holding magnet can act with a maximum adhesive force on the component 12 and fix it with respect to the contact surface 36.

The displacement and the displacement mechanism can take place in the same way as the embodiments described above. The embodiments of particular design in this respect which can be transferred to an interlayer of this type, to its displacement technique and to its displacement likewise apply.

The interlayer may, for example, consist completely of a highly permeable magnetic material which has, for example, stamped-out portions for the free spaces. It is also possible to use a conventional material which has stamped-out free spaces and the areas of which consist of highly permeable magnetic material which is inserted in the interlayer.

Furthermore, it is possible to use a combination of the configuration of a component carrier with an interlayer with an embodiment as shown in FIGS. 1 to 7 or FIGS. 8 and 9. Depending on the adhesion force required to fix the component during the machining, treating or coating process, it may be advantageous if the reduction in the adhesive force brought about by displacement of the holding magnet or of the component or by a relative movement is assisted by positioning an interlayer beneath the component. Further advantageous combinations of the embodiments described above are also possible.

What is claimed is:

1. A component carrier for holding at least one component, in particular for surface coating by electrodeposition, having at least one holding magnet, the magnetic field lines of which run through the component in a region close to a contact surface, having a diaphragm, which accommodates the at least one component in a holding position with respect to the at least one holding magnet on at least one contact surface of an electrically conductive housing, the pole axis of the at least one holding magnet being positioned transversely with respect to the contact surface, characterized in that a resulting magnetic holding force which acts on the at least one component in the holding position is reducible by displacement of the at least one holding magnet out of the holding position or by displacement of the at least one component along the contact surface out of the holding position or by a relative movement of the at least one component along the contact surface and the at least one holding magnet with respect to the holding position for removal of the at least one component.

2. The component carrier as claimed in claim 1, characterized in that a plurality of holding positions, which comprise at least two lines and two columns, at least one holding position being provided for each line and column, are provided on at least one contact surface.

3. The component carrier according to claim 2, characterized in that at least two pole strips which are of opposite polarity to the components, face the latter and extend completely or partially along the column or line, are provided for each line or column.

4. The component carrier according to claim 1, characterized in that the diaphragm has an array of holes for the holding position, which preferably includes at least one area comprising rows and columns, the number of which is preferably based on a binary code.

5. The component carrier according to claim 1, characterized in that the holding magnet has an individual holding magnet, which comprises at least two magnetic poles facing the at least one component, for each holding position.

6. The component carrier as claimed in claim 5, characterized in that the individual holding magnet comprises two dipole magnets which are separated by a neutral zone and are arranged with opposite polarities toward the contact surface of the holding position.

7. The component carrier as claimed in claim 6, characterized in that a plurality of individual magnets, which are arranged so as to form a line or column, have identical orientation pointing toward the contact surface.

8. The component carrier as claimed in claim 6, characterized in that a plurality of individual magnets which are arranged to form a line or column have an alternating orientation pointing toward the contact surface.

9. The component carrier as claimed in claim 5, characterized in that in a row or column the number n of holding positions is provided and at least the number (n+1) of individual holding magnets is provided.

10. The component carrier as claimed in claim 1, characterized in that a carriage, which accommodates the individual holding magnets in such a manner that they are displaced with respect to the respective holding position, is provided in the housing.

11. The component carrier as claimed in claim 10, characterized in that the carriage has a plate and strips arranged thereon, which accommodates left and right magnets arranged at a distance form one another so as to form individual holding magnets, the strip forming a neutral zone in sections between the magnets.

12. The component carrier as claimed in claim 10, characterized in that the carriage, by means of a rolling bearing arrangement, is arranged so that it is moveable with respect to a support frame fixed in the housing, the rolling bearing arrangement preferably being designed as a ball bearing.

13. The component carrier as claimed in claim 12, characterized in that the displaceable plate of the carriage has slot-like recesses, in which guide rolls for the lateral guidance of the carriage are provided, a rotation pin of the guide roll being arranged perpendicular to the carriage plane and being secured in the support plate.

14. The component carrier as claimed in claim 12, characterized in that the support frame has slot-like recesses in which the individual holding magnets assigned to the strip are positioned, preferably without contact.

15. The component carrier as claimed in claim 12, characterized in that the webs which are formed between the recesses are provided as support webs for accommodating a film or foil which closed off the interior of the housing as contact surface.

16. The component carrier as claimed in claim 12, characterized in that the individual holding magnets arranged on the carriage are arranged in the recesses with at least a small air gap with respect to the contact surface.

17. The component carrier as claimed in claim 10, characterized in that the carriage, on each end side which lies transversely with respect to the direction of movement, has magnet elements which are positioned close to the frame of the opposite side faces.

18. The component carrier as claimed in 17, characterized in that the magnet elements are indentations which reduce the wall thickness of the frame.

19. The component carrier as claimed in claim 17, characterized in that the housing is fitted onto a bracket which on two opposite end sides has magnets which are arranged opposite the magnet elements of the carriage.

20. The component carrier as claimed in claim 17, characterized in that the magnet elements of the carriage on both end sides have the same polarity, and the magnets of the bracket are oriented with opposite polarities.

21. The component carrier as claimed in claim 17, characterized in that, for mounting and removal of the components, the carriage is arranged in a mounting and/or removal position, in which the individual holding magnets are arranged substantially between the holding positions, in the housing by means of the magnetic action of the bracket.

22. The component carrier as claimed in claim 17, characterized in that, after removal of the mounted housing from the bracket, the carriage is transferred into a holding position, in which the resulting holding magnetic force is substantially congruent with the center axis of the components, by the magnetic force of the individual holding magnets.

23. The component carrier as claimed in claim 1, characterized in that the electrically conductive housing has a frame which bears the support frame and a base plate, an upper side of the housing being closed off by means of a conductive contact surface, and the further side faces of the housing being enclosed by a coating.

24. The component carrier as claimed in claim 23, characterized in that the coating of the housing is a preferably acid-resistant plastic coating, in particular and ECTFE coating.

25. The component carrier as claimed in claim 23, characterized in that the contact surface and the coating of the housing end in an airtight fashion and an inert gas, in particular sulfur hexafluoride or argon, is preferably provided in the housing.

26. The component carrier as claimed in claim 1, characterized in that the contact surface is a nickel foil which is preferably rhodium-plated or platinum-plated.

27. The component carrier as claimed in claim 1, characterized in that the housing has at least one clamping pin and a contact bolt, which are advantageously formed as a single part.

28. The component carrier as claimed in claim 1, characterized in that the diaphragm is designed as a perforated diaphragm which has receiving bores which correspond to the number and arrangement of the individual holding magnets.

29. The component carrier as claimed in claim 28, characterized in that the bore for cylindrical components at a first diameter has guide sections which are in the form of segments of a circle and between which flushing channels of larger diameter are provided.

30. The component carrier as claimed in claim 29, characterized in that the first diameter of the guide segments is at most 1% greater than the component diameter.

31. The component carrier as claimed in claim 1, characterized in that the diaphragm is formed from nonconductive material, in particular ceramic or the like, which preferably has an acid-resistant coating.

32. The component carrier as claimed in claim 1, characterized in that the diaphragm is spaced apart from the contact surface and preferably has flushing channels on the surface which faces toward the contact surface.

33. The component carrier as claimed in claim 1, characterized in that the maximum displacement between component and holding magnet amounts to half of a gauge distance (A) being two components, the gauge distance being the distance between the center axes of the two adjacent components.

34. The component carrier as claimed in claim 33, characterized in that the gauge distance (A) is at least 1.5 times a component diameter, preferably twice this diameter.

35. The component carrier as claimed in claim 1, characterized in that the holding magnet is designed as a double magnet with opposite polarity of the magnet poles with respect to the holding position, as a cylindrical magnet, as an annular magnet, as a cube-shaped magnet or the like.

36. The component carrier as claimed in claim 1, characterized in that the holding force of the at least one holding magnet is greater than ten times, preferably a hundred times, the weight of the component itself.

37. The component carrier as claimed in claim 1, characterized in that the cross-sectional area of the holding magnet substantially corresponds to a peripheral surface area of the component or is smaller than this area.

38. Component carrier for holding at least one component, in particular for surface coating by electrodeposition, having at least one holding magnet, the magnetic field lines of which run through the component in a region close to a contact surface, having a diaphragm which accommodates the at least one component in a holding position with respect to the at least one holding magnet on at least one contact surface of an electrically conductive housing, the pole axis of the at least one holding magnet being oriented transversely with respect to the contact surface, characterized in that a resulting magnetic holding force which acts on the at least one component in the holding position is reducible by means of a magnetic interlayer which is arranged between component and holding magnet.

39. The component carrier as claimed in claim 38, characterized in that the interlayer is provided displaceably in the housing, preferably between the contact surface and the holding magnets.

40. The component carrier as claimed in claim 38, characterized in that the interlayer is arranged in a position, at least for removal, in which areas of the interlayer is positioned between the component and the holding magnet.

41. The component carrier as claimed in claim 40, characterized in that the interlayer, between the areas, has free spaces which are positioned between contact surface and holding magnets for the purpose of fixing the components with respect to the contact surface.

42. The component carrier as claimed in claim 40, characterized in that at least the areas of the interlayer are formed from highly permeable material.

* * * * *